US005707540A

United States Patent [19]

Maruyama et al.

[11] Patent Number: 5,707,540

[45] Date of Patent: Jan. 13, 1998

[54] FIBER TREATMENT CHEMICAL AND FIBER TREATMENT COMPOSITION

[75] Inventors: Akihiro Maruyama, Chiba-ken; Seijiro Sato, Yokohama, both of Japan

[73] Assignee: Boehgan Trading Co., Ltd., Tokyo, Japan

[21] Appl. No.: 603,251

[22] Filed: Feb. 20, 1996

[30] Foreign Application Priority Data

Feb. 22, 1995 [JP] Japan ..... 7-057915
Dec. 22, 1995 [JP] Japan ..... 7-350376

[51] Int. Cl.[6] ..... D06M 13/224

[52] U.S. Cl. ..... 252/8.63; 252/8.61; 252/8.81; 252/8.82; 252/8.84; 252/8.86; 252/8.91; 428/260; 428/262

[58] Field of Search ..... 252/8.61, 8.63, 252/8.81, 8.82, 8.84, 8.86, 8.91; 428/260, 262

[56] References Cited

U.S. PATENT DOCUMENTS 2,733,252 1/1956 Thompson ..... 554/165
4,010,196 3/1977 Tsuk ..... 560/185
4,146,548 3/1979 Forsythe ..... 554/170
4,559,151 12/1985 Pregozen et al. ..... 252/8.91
4,711,241 12/1987 Lehmann ..... 128/335.5

FOREIGN PATENT DOCUMENTS 2-216734 8/1995 Japan .

*Primary Examiner*—Anthony Green
*Attorney, Agent, or Firm*—Kanesaka & Takeuchi

[57] ABSTRACT

A fiber treatment chemical includes a lactic ester derivative represented by the following formula (1):

$$RCO-(\underset{\underset{CH_3}{|}}{OCHCO})_n-OX \quad (1)$$

wherein RCO means a fatty acid having 12–32 carbon atoms, n stands for a number of 1–4, and X denotes hydrogen, a monovalent or divalent metal, ammonium, or amine. A fiber treatment composition comprising this fiber treatment chemical, and fiber and textile goods are treated with the fiber treatment chemical or fiber treatment composition.

11 Claims, No Drawings

FIBER TREATMENT CHEMICAL AND FIBER TREATMENT COMPOSITION

BACKGROUND OF THE INVENTION

1. Field of the Invention

The present invention relates to fiber treatment chemicals, which are low in toxicity, imparts softness, smoothness and/or antistatic ability to fibers or textile goods in fiber-producing processes, textile finishing processes or homes, and have little possibility of impairing water absorption property, and fiber treatment compositions containing such a fiber treatment chemical.

2. Description of the Background Art

Surfactants are used as fiber treatment chemicals in various applications with a view toward imparting softness, antistatic ability and/or the like to fibers. However, many of the conventional surfactants used in softening treatments for fibers have incurred possibility of causing dermatopathy, pollution problem or the like as alkyldimethylammonium chlorides. Besides, surfactants greatly vary in function according to their ionic natures. Therefore, cationic surfactants or anionic surfactants are used as necessary for the end application intended.

For example, anionic surfactants are far poorer in feeling than cationic surfactants, and so a cationic surfactant is mainly used in a treatment of fiber intended for soft finish. It is also common to use the anionic surfactant as a detergent for fiber.

However, in the cationic surfactants, a serious problem of skin irritation has not been yet solved in addition to a problem that they tend to cause problems of reduced fastness properties, washing-out of color, discoloration and the like. Further, the cationic surfactants have low biodegradability, so that a treatment of waste water containing the cationic surfactant is confronted with a serious problem at present. Furthermore, fibers and textile goods treated with the cationic surfactants have involved a problem that their water absorption property is deteriorated.

The anionic surfactants have high biodegradability and can solve the various problems involved in the cationic surfactants. However, they have been able to be used as detergents for fiber, but have been unsatisfactory for softly finishing agents as described above. The anionic surfactants and the cationic surfactants have low compatibility with each other, and so it is difficult to use both surfactants in combination. Therefore, a washing process and a softly finishing process have had to be performed separately, and operation steps have hence become increased and complicated.

SUMMARY OF THE INVENTION

The present invention has been made in view of the foregoing circumstances, and has as its object the provision of a fiber treatment chemical, which has excellent effects as a softly finishing agent though it is an anionic surfactant, and can solve the above various problems involved in the cationic surfactants heretofore in use as softly finishing agents, and a fiber treatment composition containing such a fiber treatment chemical.

According to the present invention, there is thus provided a fiber treatment chemical comprising a lactic ester derivative represented by the following formula (1):

$$\mathrm{RCO-(\underset{\substack{|\\ CH_3}}{OCHCO})_n-OX} \qquad (1)$$

wherein RCO means a fatty acid having 12–32 carbon atoms, n stands for a number of 1–4, and X denotes hydrogen, a monovalent or divalent metal, ammonium, or amine.

According to the present invention, there is also provided a fiber treatment composition comprising the fiber treatment chemical described above in a proportion of at least 40 wt. % of active ingredients in the composition.

According to the present invention, there is further provided fiber or textile goods treated with the fiber treatment chemical or fiber treatment composition described above.

The above and other objects, features and advantages of the present invention will become apparent from the following description and the appended claims.

DETAILED DESCRIPTION OF THE PREFERRED EMBODIMENTS

The compound represented by the formula (1) is a compound having a structure that 1 to 4 moles of lactic acid are condensed with 1 mole of a fatty acid having 12–32 carbon atoms with elimination of water, or a salt thereof (the compound represented by the formula (1) will hereinafter be referred to as the "lactic ester derivative"). In the formula (1), X means hydrogen, a monovalent or divalent metal, ammonium, or amine. However, these radicals may be present either singly or in any combination thereof. Examples of the monovalent or divalent metal include alkali metals and alkaline earth metals such as lithium, potassium, sodium, calcium and magnesium. Examples of the amine include monoethanolamine, diethanolamine, triethanolamine, propanolamine and the like. In the case where a softness-imparting effect is mainly required of the fiber treatment chemical, X may preferably be selected from the group consisting of the amine and monovalent metals. In the case where a softness and smoothness-imparting effect is mainly required of the fiber treatment chemical, X may preferably be selected from the group consisting of the diethanolamine, triethanolamine and propanolamine. In the case where an antistatic effect is mainly required of the fiber treatment chemical, X may preferably be selected from the group consisting of the monovalent metals and monoethanolamine residue. Further, in the case where 2 or more effects are required of the fiber treatment chemical, lactic ester derivatives, which are different from each other in the kind of X, are used in combination as necessary for the end application intended. However, those in which X is potassium, sodium and/or calcium are preferred from the viewpoint of low toxicity.

The above relationship between the kind of X in the lactic ester derivative and the finishing effect is a sort of standard for obtaining a more preferable effect. As will be described subsequently, the effects are also affected by the number of carbon atoms in the fatty acid moiety of the lactic ester derivative. Accordingly, for example, in the case where the softness and smoothness-imparting effect is mainly required of the fiber treatment chemical, X may preferably be selected from the group consisting of the diethanolamine, triethanolamine and propanolamine as described above. It is however not that the softness and smoothness-imparting effect cannot be obtained unless X is the diethanolamine, triethanolamine and/or propanolamine.

Examples of the fatty acid having 12–32 carbon atoms include straight-chain saturated fatty acids such as lauric acid, myristic acid, palmitic acid, stearic acid, arachidic acid, behenic acid and montanic acid; straight-chain unsaturated fatty acids such as oleic acid, linolic acid and linolenic acid; and branched fatty acids such as isostearic acid. These fatty acids may be used either singly or in any combination thereof. Lower alcohol esters of these fatty acids may also be used. In the case where the softness-imparting effect is mainly required of the fiber treatment chemical according to the present invention, a fatty acid having at least 18 carbon atoms is preferred as the fatty acid. In the case where the smoothness-imparting effect is mainly required of the fiber treatment chemical, a fatty acid having 12–14 carbon atoms is preferred. Further, in the case where the antistatic effect is mainly required of the fiber treatment chemical, a fatty acid having 12–18 carbon atoms is preferred.

In the formula (1), it is necessary for n to be 1–4. It is however preferred that n be 1 or 2. Incidentally, n is not always an integer because it is an average value.

The lactic ester derivative can be obtained, for example, by subjecting 1 to 4 moles of lactic acid to condensation with elimination of water for about 1–3 hours at 100°–110° C. with stirring and then adding 1 mole of the fatty acid having 12–32 carbon atoms or the lower alcohol ester thereof, and the hydroxide of the alkali metal or alkaline earth metal or its neutralized product with carbonic acid, or an alkaline compound such as ammonia or the amine to subject the fatty acid having 12–32 carbon atoms or the lower alcohol ester thereof and the lactic acid to condensation with elimination of water or alcohol while stirring further for about 3–6 hours at 160°–200° C.

The lactic ester derivative may be diluted with water, a lower alcohol such as ethyl alcohol, or a lower alcohol ester such as a lactic ester, citric ester or malic ester, or may be used in combination with a dispersion stabilizer as needed.

Examples of the dispersion stabilizer include alkylene oxide adducts of higher alcohols such as lauryl alcohol and cetyl alcohol, and compounds such as castor oil, hydrogenated castor oil, fatty acid alkanolamides, sucrose fatty acid esters and fatty acids; monoglyceryl stearate, sorbitan fatty acid esters, sucrose fatty acid esters and alkyl polyglycosides; amino acid type surfactants such as alkyloylglutamic acid salts and alkylacylglutamic acid salts; water-soluble polymeric compounds such as CMC, casein, lecithin, xanthan gum and poly(vinyl alcohol); and lower alcohol such as methyl alcohol, ethyl alcohol and propyl alcohol. These compounds may be used either singly or in any combination thereof.

When the lactic ester derivative represented by the formula (1) is used in the form of a fiber treatment composition in combination with the dispersion stabilizer and/or the like, the lactic ester derivative may preferably be contained in a proportion of at least 40 wt. % based on the active ingredients (ingredients other than water) in the composition.

When fiber or textile goods are treated with the fiber treatment chemical or fiber treatment composition according to the present invention, it is preferable to treat the fiber or textile goods in such a manner that the amount of the lactic ester derivative adhered is of the order of 0.1–1.0 wt. %. When the fiber or textile goods are treated, it is preferable to prepare a treating solution in such a manner that the lactic ester derivative is contained in an amount of at least 0.1 wt. % in the treating solution. A method in which the fiber or textile goods are immersed in or sprayed with this treating solution is adopted.

Examples of materials for fibers and textile goods to be treated in accordance with the present invention include natural fibers such as cotton, hemp, silk and wool; fibers formed of biodegradable resins comprising, as a raw material, lactic acid and/or polylactic acid; chemical fibers such as rayon and acetate; synthetic fibers such as polyester fiber, polyamide fiber, polyacrylic fiber and polypropylene fiber; and mixed fibers thereof. The fibers and textile goods treated with the fiber treatment chemical or fiber treatment composition according to the present invention are excellent in softness and have little possibility of impairing water absorption property. Besides, the fiber treatment chemicals and fiber treatment compositions according to the present invention have low toxicity and very low skin irritativeness and are hence particularly suitable for use in the treatment of textile goods used in direct contact with the skin, such as towels, underwear, stockings, shirts and blouses, and of fibers used as raw materials thereof.

The present invention will hereinafter be described in more detail by the following examples.

EXAMPLES 1–4 AND COMPARATIVE EXAMPLES 1–2

Each of samples (100% cotton knitted fabrics) was immersed in a treating solution containing its corresponding lactic ester derivative (sodium salt) wherein the number of carbon atoms of R in the fatty acid residue [the number of carbon atoms of R in the RCO moiety in the formula (1)] and the value of n are shown in Table 1, thereby treating the sample in such a manner that the amount of the lactic ester derivative adhered to the sample was 0.1 wt. %. The softness, specific resistance and water absorption property of the samples after the treatment and an untreated sample were determined and evaluated in accordance with the following methods. The results are shown in Table 1. Incidentally, in Comparative Examples 1 and 2, distearyldimethylammonium chloride and an amide type cationic surfactant were used respectively as fiber treatment chemicals to conduct a treatment in such a manner that the amount of each of these treatments adhered was 0.1 wt. % like Examples 1–4.

Softness

A feeling of each sample after the treatment to the touch was compared with that of the sample before the treatment to rank it in accordance with the following standard:

5: Markedly softer;
4: Considerably softer;
3: Softer;
2: Somewhat softer;
1: Slightly softer;
0: No softer than before the treatment.

Water Absorption Property

The water absorption property was expressed in terms of the wicking heights (mm) of water after 30 seconds, 1 minute, 2 minutes, 3 minutes and 5 minutes from the beginning of the test.

Specific Resistance

After each of the samples was left at rest for 24 hours in a room controlled at 20° C. and 40% RH, its specific resistance was measured by means of a high-performance ohmmeter (TR-2 model, manufactured by Tokyo Denshi K.K.).

TABLE 1

| | Lactic ester derivative | | | Specific | Water absorption property (mm) | | | | |
|---|---|---|---|---|---|---|---|---|---|
| | Number of carbon atoms of R | Value of n | Softness | resistance (Ω · cm) | After 30 sec | After 1 min | After 2 min | After 3 min | After 5 min |
| Ex. 1 | 11 | 2 | 2 | $10^8$ | 40 | 55 | 65 | 75 | 95 |
| Ex. 2 | 15 | 2 | 3 | $10^9$ | 33 | 42 | 53 | 59 | 68 |
| Ex. 3 | 17 | 2 | 4 | $10^9$ | 30 | 40 | 50 | 57 | 65 |
| Ex. 4 | 21 | 2 | 4–5 | $10^{10}$ | 20 | 28 | 35 | 42 | 52 |
| Comp. Ex. 1 | — | | 4 | $10^{16}$ | 15 | 19 | 23 | 26 | 28 |
| Comp. Ex. 2 | — | | 4 | $10^{12}$ | 10 | 15 | 18 | 19 | 20 |
| Blank | — | | 0 | $10^8$ | 40 | 55 | 70 | 80 | 98 |

As apparent from the results shown in Table 1, the fiber treatment chemicals according to the present invention had the same softness-imparting effect as the cationic surfactants, and the samples treated with the fiber treatment chemicals according to the present invention were higher in antistatic ability and better in water absorption property than those treated with the cationic surfactants and also higher in whiteness.

EXAMPLES 5–6 AND COMPARATIVE EXAMPLES 3–5

Each of samples (nylon taffeta) was immersed in a treating solution containing its corresponding lactic ester derivative (potassium salt) wherein the number of carbon atoms of R in the fatty acid residue [the number of carbon atoms of R in the RCO moiety in the formula (1)] and the value of n are shown in Table 2, thereby treating the sample in such a manner that the amount of the lactic ester derivative adhered to the samples was 0.35 wt. %. Incidentally, in Comparative Examples 3, 4 and 5, a dispersion in an aqueous acetic acid solution of a compound with 0.5 mole of epichlorohydrin added to 1 mole of diethylenetriamine-bis(stearyl)amide, a stearylbetaine type amphoteric surfactant, and a polyoxyethylene (7 E.O.) sorbitan stearate were used respectively as fiber treatment chemicals to conduct a treatment in such a manner that the amount of each of these treatments adhered was 0.35 wt. % like Examples 5–6. The softness, specific resistance and water absorption property of the samples after the treatment and an untreated sample were determined and evaluated under the same conditions as described above, and their whiteness was determined and evaluated under the following conditions. The results are shown in Table 2.

Whiteness

Each of the samples after the treatment was placed together with an untreated sample (blank) on a black mount in such a manner that the weave pattern and thickness of both samples were equal to each other, and exposed to diffused light transmitted through an open window facing the north at an angle of 45°–60°. The samples were observed from a direction perpendicular to the samples, whereby a difference in whiteness between the sample after the treatment and the blank was visually discriminated to rank it in accordance with the following standard:

5: Better in whiteness than the blank;

4: Somewhat better in whiteness than the blank;

3: Equal in whiteness to the blank;

2: Somewhat poorer in whiteness than the blank;

1: Considerably poorer in whiteness than the blank.

TABLE 2

| | Lactic ester derivative | | | Specific | Water absorption | |
|---|---|---|---|---|---|---|
| | Number of carbon atoms of R | Value of n | Softness | resistance (Ω · cm) | property (mm) After 5 min | Whiteness |
| Ex. 5 | 17 | 1.75 | 4 | $10^9$ | 62 | 5 |
| Ex. 6 | 21 | 1.75 | 4–5 | $10^{10}$ | 50 | 4 |
| Comp. Ex. 3 | — | | 4 | $10^{12}$ | 10 | 1 |
| Comp. Ex. 5 | — | | 2 | $10^{10}$ | 45 | 1 |
| Comp. Ex. 6 | — | | 1 | $10^{12}$ | 50 | 1 |
| Blank | — | | 0 | $<10^{13}$ | 1– | — |

As apparent from the results shown in Table 2, the fiber treatment chemicals according to the present invention had the same softness-imparting effect as the cationic surfactant, and the samples treated with the fiber treatment chemicals according to the present invention were higher in antistatic ability and better in water absorption property than that treated with the cationic surfactant and also higher in whiteness than those treated with the fiber treatment chemicals of the comparative examples.

Then, fiber treatment chemicals according to the present invention were used to prepare fiber treatment compositions No. 1 to No. 3 having their corresponding formulations shown in Table 3, whereby they were compared in fiber-treatment effects with the conventional fiber treatment compositions. The kinds [the number of carbon atoms of R, kind of X and value of n in the formula (1)] of the fiber treatment chemicals (lactic ester salts) according to the present invention in the fiber treatment compositions used in the following examples are shown collectively in Table 3. Incidentally, all designations of "Amount blended" in Table 3 mean parts by weight.

TABLE 3

| | Lactic ester derivative | | | | Fatty acid ester | | Amount of mildew | Amount |
|---|---|---|---|---|---|---|---|---|
| | Number of carbon atoms of R | Kind of X | Value of n | Amount blended | Kind | Amount blended | proofing agent blended | of water blended |
| Fiber treatment composition No. 1 | Mixture of 17–21 | Na | 2 | 10 | Sucrose fatty acid (C = 18) ester | 2 | 0.1 | 87.9 |
| Fiber treatment composition No. 2 | 17 | Na | 2 | 13 | Glycerol fatty acid (C = 18) ester | 2 | 0.1 | 84.9 |
| Fiber treatment composition No. 3 | Mixture of 17–21 | Na | 2 | 9 | Sucrose fatty acid (C = 18) ester | 2 | 0.1 | 88.9 |

EXAMPLES 7–9 AND COMPARATIVE EXAMPLES 6–8

Dyed products of bleached knitted fabrics (density of fabric: 500 g/m) were used as samples. Each of treating solutions shown in Table 4 was held at 40° C. The sample was immersed in this treating solution for 10 minutes at a bath ratio of 1:25, dehydrated to a pickup of 35% and then dried for 5 minutes at 110° C. Incidentally, fiber treatment compositions No. 4 to No. 6 are as follows:

Fiber Treatment Composition No. 4

An aqueous solution of an amide type cationic surfactant (content of active ingredient: 15 wt. %).

Fiber Treatment Composition No. 5

An aqueous solution of a mixture of a sodium alkylsulfate type anionic surfactant and a glycerol ester type nonionic surfactant (content of active ingredient: 15 wt. %).

Fiber Treatment Composition No. 6

An aqueous solution of an aminopolysiloxane type surfactant (content of active ingredient: 20 wt. %).

The softness and smoothness, water absorption property, whiteness inhibiting tendency, antistatic property, color fastness to daylight, color fastness to washing, color fastness to perspiration, and color fastness to rubbing of the samples after the treatment were determined. The results are shown in Table 4. The conditions and standards of the individual tests are as follows.

Softness and Smoothness

A feeling of each sample after the treatment to the touch was ranked in accordance with the following five-grade standard:

5: Very soft to the touch and excellent in smoothness;
4: Soft and smooth to the touch;
3: Somewhat soft and smooth to the touch;
2: Somewhat lacking in softness and smoothness;
1: Lacking in softness and smoothness and hard to the touch.

Water Absorption Property

The water absorption property was expressed in terms of the wicking height (mm) of water after 10 seconds from the beginning of the test.

Whiteness Inhibiting Tendency

After each sample was subjected to a heat treatment for 3 minutes at 150° C., it was visually observed on whiteness and ranked in accordance with the following three-grade standard:

3: No reduction in whiteness was observed;
2: Yellowing was somewhat observed;
1: Yellowed.

Antistatic Property

An initial frictional electricity (V) of each of the samples after the treatment was measured in accordance with the method set forth in JIS L 1094.

Color Fastness to Daylight

With respect to each of the samples after the treatment, the color fastness to daylight was determined by a 20-hour exposure test by means of a fade meter in accordance with JIS L 0841.

Color Fastness to Washing

With respect to each of the samples after the treatment, the color fastness to washing was determined in accordance with JIS L 0844 A2.

Color Fastness to Perspiration

With respect to each of the samples after the treatment, the color fastness to perspiration was determined in accordance with JIS L 0848 A (alkali, acid).

Color Fastness to Rubbing

Each of the samples after the treatment was subjected to a rubbing test each 100 times in dry and wet states by means of a testing crockmeter according to JIS L 0849 to determine the color fastness to rubbing in both dry and wet states.

The above color fastness to daylight, color fastness to washing, color fastness to perspiration and color fastness to rubbing were ranked and expressed by classifying results of comparison by a gray scale into first to fifth steps.

TABLE 4

| | Example | | | Comparative Example | | | |
|---|---|---|---|---|---|---|---|
| Treating solution | 7 1/500 Dilute solution of fiber treatment composition No. 1 | 8 1/500 Dilute solution of fiber treatment composition No. 2 | 9 1/500 Dilute solution of fiber treatment composition No. 3 | 6 1/500 Dilute solution of fiber treatment composition No. 4 | 7 1/500 Dilute solution of fiber treatment composition No. 5 | 8 1/500 Dilute solution of fiber treatment composition No. 6 | Blank — |
| Properties of treated sample: | | | | | | | |
| Softness and smoothness | 3 | 3 | 4 | 5 | 2 | 4 | 1 |
| Water absorption property | 30 | 40 | 20 | 0 | 30 | 20 | 40 |
| Whiteness inhibiting tendency | 3 | 3 | 3 | 1 | 3 | 2 | 3 |
| Antistatic property | 500 | 600 | 700 | 900 | 850 | 900 | 900 |
| Fastness to daylight | 4–5 | 4–5 | 4–5 | 4–5 | 4–5 | 4–5 | 4–5 |
| Fastness to washing | 4 | 4 | 4 | 4 | 4 | 4 | 4 |
| Fastness to perspiration | | | | | | | |
| Acid | 5 | 5 | 5 | 5 | 5 | 5 | 5 |
| Alkali | 5 | 5 | 5 | 5 | 5 | 5 | 5 |
| Fastness to rubbing | | | | | | | |
| Dry | 4–5 | 4–5 | 4–5 | 4–5 | 4–5 | 4–5 | 4–5 |
| Wet | 3 | 3 | 3 | 3 | 3 | 3 | 3 |

EXAMPLES 10–11 AND COMPARATIVE EXAMPLES 9–10

Acrylic knitted fabrics with a raised back after subjected to scouring and bleaching were used as samples. Each of treating solutions shown in Table 5 was held at 35° C. The sample was immersed in this treating solution for 15 minutes at a bath ratio of 1:20, dehydrated to a pickup of 30% and then dried for 7 minutes at 100° C. Incidentally, fiber treatment compositions No. 7 and No. 8 are as follows:

Fiber Treatment Composition No. 7

A commercially-available softener for acrylic fibers, which comprises a polyamide type cationic surfactant as a main component (content of active ingredient: 15 wt. %).

Fiber Treatment Composition No. 8

A commercially-available raising agent of an emulsifier mixed system (content of active ingredient: 20 wt. %).

The softness and smoothness, antistatic property, color fastness to daylight, color fastness to washing, color fastness to perspiration, and color fastness to rubbing of the samples after the treatment were evaluated in accordance with the same standards as those in Examples 7–9. The results are shown in Table 5.

TABLE 5

| | Example | | Comparative Example | | |
|---|---|---|---|---|---|
| Treating solution | 10 1/500 Dilute solution of fiber treatment composition No. 1 | 11 1/500 Dilute solution of fiber treatment composition No. 3 | 9 1/500 Dilute solution of fiber treatment composition No. 7 | 10 1/500 Dilute solution of fiber treatment composition No. 8 | Blank — |
| Properties of treated sample: | | | | | |
| Softness and smoothness | 4–5 | 4–5 | 5 | 3 | 2 |
| Antistatic property | 1000 | 1200 | 2000 | 1200 | 5000 |
| Fastness to daylight | 4–5 | 4–5 | 4–5 | 4–5 | 4–5 |
| Fastness to washing | 4 | 4 | 4 | 4 | 4 |
| Fastness to perspiration | | | | | |
| Acid | 5 | 5 | 5 | 5 | 5 |
| Alkali | 5 | 5 | 5 | 5 | 5 |
| Fastness to | | | | | |

TABLE 5-continued

| | Example | | Comparative Example | | |
|---|---|---|---|---|---|
| | 10 | 11 | 9 | 10 | |
| Treating solution | 1/500 Dilute solution of fiber treatment composition No. 1 | 1/500 Dilute solution of fiber treatment composition No. 3 | 1/500 Dilute solution of fiber treatment composition No. 7 | 1/500 Dilute solution of fiber treatment composition No. 8 | Blank — |
| rubbing | | | | | |
| Dry | 5 | 5 | 5 | 5 | 5 |
| Wet | 5 | 5 | 5 | 5 | 5 |

EXAMPLES 12–14 AND COMPARATIVE EXAMPLES 11–13

Polyester/cotton mixed knitted fabrics (using No. 60 thread, density of fabric: 500 g/m) were used as samples. Each of treating solutions shown in Table 6 was held at 35° C. The sample was immersed in this treating solution for 15 minutes at a bath ratio of 1:20, dehydrated to a pickup of 35% and then dried for 7 minutes at 100° C. Incidentally, fiber treatment compositions No. 9 to No. 11 are as follows:

Fiber Treatment Composition No. 9

A commercially-available softener comprising a polyamide type cationic surfactant as a main component (content of active ingredient: 15 wt. %).

Fiber Treatment Composition No. 10

A commercially-available softener comprising an amino-silicone type surfactant as a main component (content of active ingredient: 20 wt. %).

Fiber Treatment Composition No. 11

A dimethylsilicone emulsion (content of active ingredient: 25 wt. %).

The softness and smoothness, antistatic property, water absorption property, color fastness to daylight, color fastness to washing, color fastness to perspiration, and color fastness to rubbing of the samples after the treatment were evaluated in accordance with the same standards as those in Examples 7–9. The results are shown in Table 6.

TABLE 6

| | Example | | | Comparative Example | | | |
|---|---|---|---|---|---|---|---|
| Treating solution | 12 1/500 Dilute solution of fiber treatment composition No. 1 | 13 1/500 Dilute solution of fiber treatment composition No. 2 | 14 1/500 Dilute solution of fiber treatment composition No. 3 | 11 1/500 Dilute solution of fiber treatment composition No. 9 | 12 1/500 Dilute solution of fiber treatment composition No. 10 | 13 1/500 Dilute solution of fiber treatment composition No. 11 | Blank — |
| Properties of treated sample: | | | | | | | |
| Softness of smoothness | 4–5 | 4 | 4–5 | 4–5 | 4–5 | 4 | 2 |
| Water absorption property | 30 | 40 | 20 | 5 | 10 | 5 | 40 |
| Antistatic property | 1100 | 1100 | 1200 | 2800 | 3200 | 2700 | 3000 |
| Fastness to daylight | 4–5 | 4–5 | 4–5 | 4–5 | 4–5 | 4–5 | 4–5 |
| Fastness to washing | 5 | 5 | 5 | 5 | 5 | 5 | 5 |
| Fastness to perspiration | | | | | | | |
| Acid | 5 | 5 | 5 | 5 | 5 | 5 | 5 |
| Alkali | 4–5 | 4–5 | 4–5 | 4–5 | 4–5 | 4–5 | 4–5 |
| Fastness to rubbing | | | | | | | |
| Dry | 4 | 4 | 4 | 4 | 4 | 4 | 4 |
| Wet | 4–5 | 4–5 | 4–5 | 4–5 | 4–5 | 4–5 | 4–5 |

EXAMPLES 15–16 AND COMPARATIVE EXAMPLES 14–15

Cotton towel cloths (750 g/dozen) were used as samples. Each of treating solutions shown in Table 7 was held at 40° C. The sample was immersed in this treating solution for 10 minutes at a bath ratio of 1:25, dehydrated to a pickup of 35% and then dried for 10 minutes at 100° C. Incidentally, fiber treatment compositions NO. 12 and No. 13 are as follows:

Fiber Treatment Composition No. 12

A commercially-available softener comprising an amide type surfactant as a main component.

Fiber Treatment Composition No. 13

A commercially-available softener comprising a sodium alkylsulfate and a glycerol fatty acid ester as main components.

The softness and smoothness and water absorption property of the samples after the treatment were evaluated in accordance with the same standards as those in Examples 7–9. Their whiteness inhibiting tendency was determined and evaluated in accordance with the following conditions. The results are shown in Table 7.

Whiteness Inhibiting Tendency

After the same cotton towel cloths were separately treated with a 1/5 dilute solution and a 1/10 dilute solution of each of the fiber treatment compositions in the same manner as described above, the treated cloths were subjected to a heat treatment for 5 minutes at 150° C. and then for 10 minutes, thereby visually observing them on yellowness and ranking them in the following four-grade standard:

4: No yellowing was observed;
3: Yellowing was observed to an extremely slight extent;
2: Yellowing was observed to a somewhat strong extent;
1: Yellowing was observed to a considerably strong extent.

TABLE 7

| | Example | | Comparative Example | | |
|---|---|---|---|---|---|
| | | | | 15 | |
| Treating solution | 15 1/500 Dilute solution of fiber treatment composition No. 2 | 16 1/500 Dilute solution of fiber treatment composition No. 3 | 14 1/333 Dilute solution of fiber treatment composition No. 12 | 1/333 Dilute solution of fiber treatment composition No. 13 | Blank — |
| Properties of treated sample: | | | | | |
| Softness and smoothness | 4–5 | 4–5 | 4–5 | 3 | 2 |
| Water absorption property | 40 | 40 | 30 | 450 | 50 |
| Whiteness inhibiting tendency | | | | | |
| 1/10 Dilution | 3–4 | 4 | 3 | 3–4 | 4 |
| 1/5 Dilution | 3 | 3 | 2–3 | 3 | 3 |

As described above, the fiber treatment chemicals according to the present invention have an excellent softness-imparting effect on fibers and textile goods, and the fibers and textile goods treated with the fiber treatment chemicals and fiber treatment compositions according to the present invention are excellent in properties such as antistatic property, water absorption property, whiteness and fastness properties compared with those treated with the cationic surfactants heretofore in use as softly finishing agents. Further, the fiber treatment chemicals according to the present invention have advantages that they are low in toxicity and have extremely low skin irritativeness compared with the cationic surfactants. Furthermore, the fiber treatment chemicals according to the present invention can be used together with anionic surfactants, so that their combined use with a detergent comprising an anionic surfactant as a main component permits treatments such as soft finishing at the same time as washing. Since the fiber treatment chemicals and fiber treatment compositions according to the present invention have high adsorptivity on fibers and textile goods, they exhibit such advantageous effects that effects to be brought about by the treatment with their agents are not lowered even when they are used in combination with a detergent, or when washing is conducted after a treatment with such an agent.

What is claimed is:

1. A fiber treatment chemical comprising a lactic ester derivative for providing softness to textile goods represented by the following formula (1), said fiber treatment chemical being excellent in antistatic property-imparting effect:

$$RCO-(\underset{\substack{|\\ CH_3}}{OCHCO})_n-OX \qquad (1)$$

wherein RCO means a fatty acid having 12–32 carbon atoms, n stands for a number of 1–4, and X is selected from the group consisting of monovalent metals and a monoethanolamine.

2. The fiber treatment chemical according to claim 1, wherein the fiber treatment chemical provides antistatic ability to the textile goods.

3. A fiber treatment composition comprising a fiber treatment chemical in a proportion of at least 40 wt % in the composition other than water, said fiber treatment chemical comprising a lactic ester derivative for providing softness to textile products represented by the following formula (1), said fiber treatment chemical being excellent in antistatic property-imparting effect:

$$RCO-(\underset{\underset{CH_3}{|}}{OCHCO})_n-OX \quad (1)$$

wherein RCO means a fatty acid having 12–32 carbon atoms, n stands for a number of 1–4, and X is selected from the group consisting of monovalent metals and a monoethanolamine.

4. The fiber treatment composition according to claim 3, further comprising a dispersion stabilizer.

5. Textile goods for use in direct contact with skin of a user comprising the textile goods treated with a fiber treatment chemical comprising a lactic ester derivative for providing softness to textile products represented by the following formula (1), said fiber treatment chemical being excellent in antistatic property-imparting effect:

$$RCO-(\underset{\underset{CH_3}{|}}{OCHCO})_n-OX \quad (1)$$

wherein RCO means a fatty acid having 12–32 carbon atoms, n stands for a number of 1–4, and X is selected from the group consisting of monovalent metals and a monoethanolamine.

6. A method of using a lactic ester derivative for providing softness to textile goods directly contacting skin of a user comprising, treating the textile goods or fibers for forming the textile goods with a fiber treatment chemical comprising a lactic ester derivative for providing softness to textile products represented by the following formula (1):

$$RCO-(\underset{\underset{CH_3}{|}}{OCHCO})_n-OX \quad (1)$$

wherein RCO means a fatty acid having 12–32 carbon atoms, n stands for a number of 1–4, and X denotes hydrogen, a monovalent or divalent metal, ammonium, or amine.

7. The method according to claim 6, wherein X in the formula (1) is selected from the group consisting of diethanolamine, triethanolamine and propanolamine, and the fiber treatment chemical is excellent in softness and smoothness-imparting effect.

8. The method according to claim 6, wherein X in the formula (1) is selected from the group consisting of monovalent metals and a monoethanolamine, and the fiber treatment chemical is excellent in antistatic property-imparting effect.

9. The method according to claim 6, wherein X in the formula (1) is selected from the group consisting of potassium, sodium and calcium, and the fiber treatment chemical has low toxicity.

10. The method according to claim 6, wherein the fiber treatment chemical is adhered to the fibers in an amount of 0.1–1.0 wt %.

11. The method according to claim 6, wherein the fiber treatment chemical provides antistatic ability to the textile goods.

* * * * *